US008316870B2

(12) United States Patent
Morris

(10) Patent No.: US 8,316,870 B2
(45) Date of Patent: Nov. 27, 2012

(54) CRUTCH DECORATION

(76) Inventor: Benjamin M. Morris, Los Angeles, CA (US)

( * ) Notice: Subject to any disclaimer, the term of this patent is extended or adjusted under 35 U.S.C. 154(b) by 13 days.

(21) Appl. No.: 12/948,737

(22) Filed: Nov. 17, 2010

(65) Prior Publication Data

US 2012/0118340 A1 May 17, 2012

(51) Int. Cl.
*A45B 3/00* (2006.01)

(52) U.S. Cl. ..... 135/66

(58) Field of Classification Search ..... 135/65, 135/66; D3/10
See application file for complete search history.

(56) References Cited

U.S. PATENT DOCUMENTS

| | | | | | |
|---|---|---|---|---|---|
| 2,210,493 | A | * | 8/1940 | Lisi | 135/66 |
| 2,423,635 | A | | 7/1947 | Blum | |
| 2,580,888 | A | * | 1/1952 | Burkett | 135/68 |
| 2,750,951 | A | | 6/1956 | Barnwell | |
| 3,545,462 | A | | 12/1970 | Mahoney | |
| 4,027,687 | A | | 6/1977 | McGowan | |
| 4,146,045 | A | | 3/1979 | Grant | |
| 4,289,156 | A | | 9/1981 | Ulics | |
| 4,295,483 | A | | 10/1981 | Smith | |
| 4,850,383 | A | | 7/1989 | McBride | |
| D310,134 | S | * | 8/1990 | Van Dyke | D3/10 |
| 5,340,005 | A | * | 8/1994 | Woods et al. | 224/407 |
| D354,392 | S | * | 1/1995 | Williams | D3/10 |
| 5,511,710 | A | * | 4/1996 | Woods et al. | 224/407 |
| 5,642,749 | A | * | 7/1997 | Perryman | 135/66 |
| 6,026,833 | A | * | 2/2000 | Conte | 135/66 |
| 7,243,667 | B2 | * | 7/2007 | Floriani | 135/68 |
| 2003/0047579 | A1 | * | 3/2003 | Vernon et al. | 224/617 |

* cited by examiner

*Primary Examiner* — Noah Chandler Hawk
(74) *Attorney, Agent, or Firm* — Lisa Pavento

(57) ABSTRACT

The present invention provides crutch decorations that when applied to a crutch form a substantially flat surface between two opposing crutch columns. The flat surface is optimally used for placing printed advertising, designs, pictures, and the like, on the crutch.

8 Claims, 4 Drawing Sheets

CRUTCH DECORATION

BACKGROUND OF THE INVENTION

Crutches have been used for thousands of years by those afflicted with lower limb injuries. While the materials used to make crutches have evolved greatly over the years, the basic functioning of the crutch has changed little. Crutches perform two functions: First, crutches reduce the weight load on an injured lower limb. Second, crutches broaden the crutch user's support base and thereby increase stability and balance (Hartman, Michael, M.D., "Crutches," emedicinehealth.com/crutches/article, Aug. 10, 2005, pp. 1-8, 2).

Crutches are used by individuals who have leg or foot pain or injury, weak lower limb muscles or an unstable gait. Crutch use not only allows these individuals to increase their mobility, but also improves their circulation, lung function and kidney function by allowing them to regain upright body movement (Id. at 3). The three basic kinds of crutches are the axillary crutch, the forearm crutch and the platform crutch. Each crutch is designed to provide a different elbow flex angle (Id.).

Over the years, several crutch accessories have been developed. Pockets, baskets, boxes, and pouches have been developed for attachment to the crutch. These accessories allow the crutch user to carry items while using crutches. Such inventions may be found in U.S. Pat. No. 2,423,635, U.S. Pat. No. 2,750,951, U.S. Pat. No. 3,545,462, U.S. Pat. No. 4,146,045, U.S. Pat. No. 4,289,156, U.S. Pat. No. 4,295,483, and U.S. Pat. No. 4,850,383. A protective cover for crutches has also been described in U.S. Pat. No. 4,027,687. The protective cover described in the '687 patent functions to protect the crutch from damage and fits snugly around the individual crutch columns for that purpose. However, none of these prior art references describes a crutch decoration which allows for designs or printed advertising to be placed on a substantially flat surface in the area between two of the opposing vertical crutch columns.

SUMMARY OF THE INVENTION

The present invention provides crutch decorations that when applied to a crutch form a substantially flat surface between two opposing crutch columns. The flat surface is optimally used for placing printed advertising, designs, pictures, and the like, on the crutch. Printed advertising can include, for example, logos, pictures and slogans from professional sports teams, collegiate sports teams, high school sports teams, and recreational sports teams. Advertisements for children's products, toys, and movies can also be placed on the crutch decorations of the present invention. The crutch decorations of the present invention can further include fashion designs and personalized pictures.

A substantially flat surface is created between two opposing crutch columns by applying one or more structure conferring members to the crutch. In some embodiments, multiple structure conferring members are applied to the crutch and together surround almost the entire crutch, only leaving the arm-pit engaging beam, the hand grip beam, and the crutch foot tip accessible and un-enclosed. Accordingly, the multiple structure conferring members create two large, substantially flat surfaces, one on each side of the crutch, which are optimal spaces for advertising and/or the placement of designs.

The structure conferring members can themselves contain printed advertising and/or designs, or in another embodiment, the structure conferring members are covered with a flexible fabric that contains dyed or printed advertising and/or designs. One important advantage provided by these embodiments of the invention is that the dyed or printed flexible fabric can be easily changed, thereby allowing the design or advertisement on the crutch to be changed quickly and/or often. In one embodiment of the present invention, the crutch decoration comprises two structure conferring members that are slidably engaged when applied to the crutch to form a combined structure conferring member. In a preferred embodiment, the combined structure conferring member is covered with stretch-fit fabric sleeve which contains printed or dyed advertising material or fashion designs.

DETAILED DESCRIPTION OF THE INVENTION

The present invention provides a decoration for use with a load-supporting frame with two or more opposing vertical frame columns, two or more frame beams, and one or more frame legs, comprising one or more structure conferring members, wherein each structure conferring member forms a substantially flat surface across an area between two opposing vertical frame columns when applied to the frame. As used herein, the term "structure conferring" refers to any material or combination of materials that forms a substantially flat surface and that retains its shape upon the application of a minimal amount of pressure, or in the alternative, returns to its original shape after a minimal amount of pressure is removed. An example of a structure conferring material that retains its shape upon the application of a minimal amount of pressure is a hardened moldable plastic. An example of a structure conferring material that returns to its original shape after a minimal amount of pressure is removed is a foam. The term "substantially flat" requires that a surface be level enough for the placement of a design or advertising such that the design or advertising can be easily viewed or read. Examples of structure conferring materials include, but are not limited to, a hardened moldable plastic, foam, cardboard, wood composite, metal, carbon fiber, fiberglass, and any combination thereof. A flexible fabric can also be a structure conferring material itself if it meets the definition of "structure conferring" as provided above. Examples of structure conferring flexible fabrics include, but are not limited to, a combination of rubber and Spandex™, or a combination of rubber and Lycra™, and neoprene. These structure conferring flexible fabrics may be easily removable by including or attaching to them a releasable means of fastening such as snaps, Velcro, ties, pins, or adhesives.

The load-supporting frame used with the present invention may be a crutch or a walker. In one embodiment, the decoration is for use with a crutch similar to that shown in FIG. 1. When applied to the crutch, the crutch decoration forms a substantially flat surface between two opposing vertical columns of the crutch. The formation of a substantially flat surface allows for designs and/or printed advertising to be placed in the expanse between two of the opposing vertical crutch columns.

Figure 1:
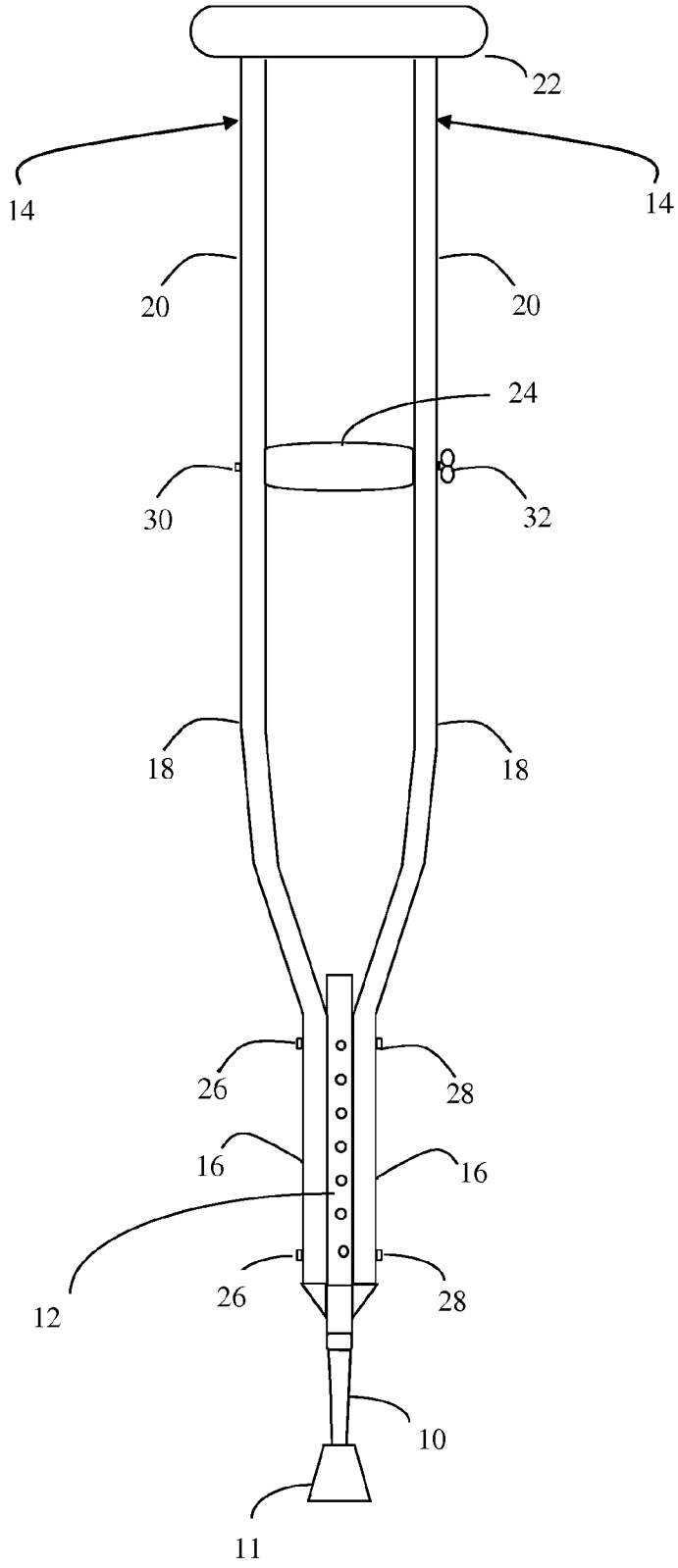
FIG. 1 is a front plan view of an axillary crutch of conventional construction.

FIG. 1 of the drawings shows a standard or conventional axillary crutch. This crutch includes an elongate, vertical, lower primary leg 10 with a lower end covered or capped tip 11 and an upper leg section 12. The crutch further includes a pair of elongate opposing vertical crutch columns 14 each of which comprises three opposing vertical crutch column sections, namely, leg intersecting crutch sections 16, lower crutch sections 18 and upper crutch sections 20. The lower crutch sections 18 are upwardly and outwardly inclined or curved, whereas the upper crutch sections 20 are substantially straight. The crutch next includes an elongate, substantially horizontal, arm-pit engaging beam 22, fixed to and extending between the upper ends of the upper crutch sections 20. The crutch also includes an elongate horizontal hand grip beam 24, fixed and extending between the vertical crutch columns 14 at a level between the arm-pit engaging beam 22 and the capped tip 11.

The vertical crutch columns 14 are secured to opposite sides of the upper leg section 12 at the leg intersecting crutch sections 16. The leg intersecting crutch sections 16 are releasably secured to the upper leg section 12 by vertically spaced pairs of through bolts 26. The bolts typically carry wing-nuts 28 to facilitate tight releasable securing of the leg 10 and vertical crutch columns 14 in assembled relationship. The leg 10 is provided with a plurality of vertically spaced pairs of bolt-receiving openings to facilitate vertical adjusting of the leg 10 relative to the vertical crutch columns 14 and resulting overall vertical adjustment of the crutch.

The hand grip beam 24 is carried by a through bolt 30 extending through the vertical crutch columns 14 and the hand grip beam 24. The bolt 30 carries a nut 32 to facilitate tightly releasably securing of the vertical columns 14 and the hand grip beam 24 together. The vertical columns 14 are provided with vertically spaced pairs of openings for the bolt 30, whereby the vertical positioning of the hand grip beam 24 relative to the arm-pit engaging beam 22 can be adjusted. The crutch structure provided in FIG. 1 is merely one example of a crutch to which the present invention can be applied. Considerable variation could be made to the crutch of FIG. 1 with little or no effect to the present invention.

The present invention includes a crutch decoration for use with a crutch having two vertical columns 14, two beams, 22 and 24, and one leg 10, comprising one or more structure conferring members, wherein each structure conferring member forms a substantially flat surface across an area between two vertical columns 14 when applied to the crutch. In some embodiments of the present invention, the substantially flat surface spans across 100% of the area between two opposing vertical crutch columns. In other embodiments, the substantially flat surface spans across 95%, 90%, 85%, 80%, or 75% of the area between two opposing vertical crutch columns. The present invention includes embodiments wherein the structure conferring member forms a substantially flat surface across an area between two opposing lower crutch sections 18, between two opposing upper crutch sections 20, between two opposing leg intersecting crutch sections 16, or any combination thereof. Structure conferring members can therefore be combined to form a substantially flat surface across an area between all of two opposing upper crutch sections 20, between two opposing lower crutch sections 18, and between two opposing leg intersecting crutch sections 16. The structure conferring members can be flat, concave or box shaped.

Figure 2:
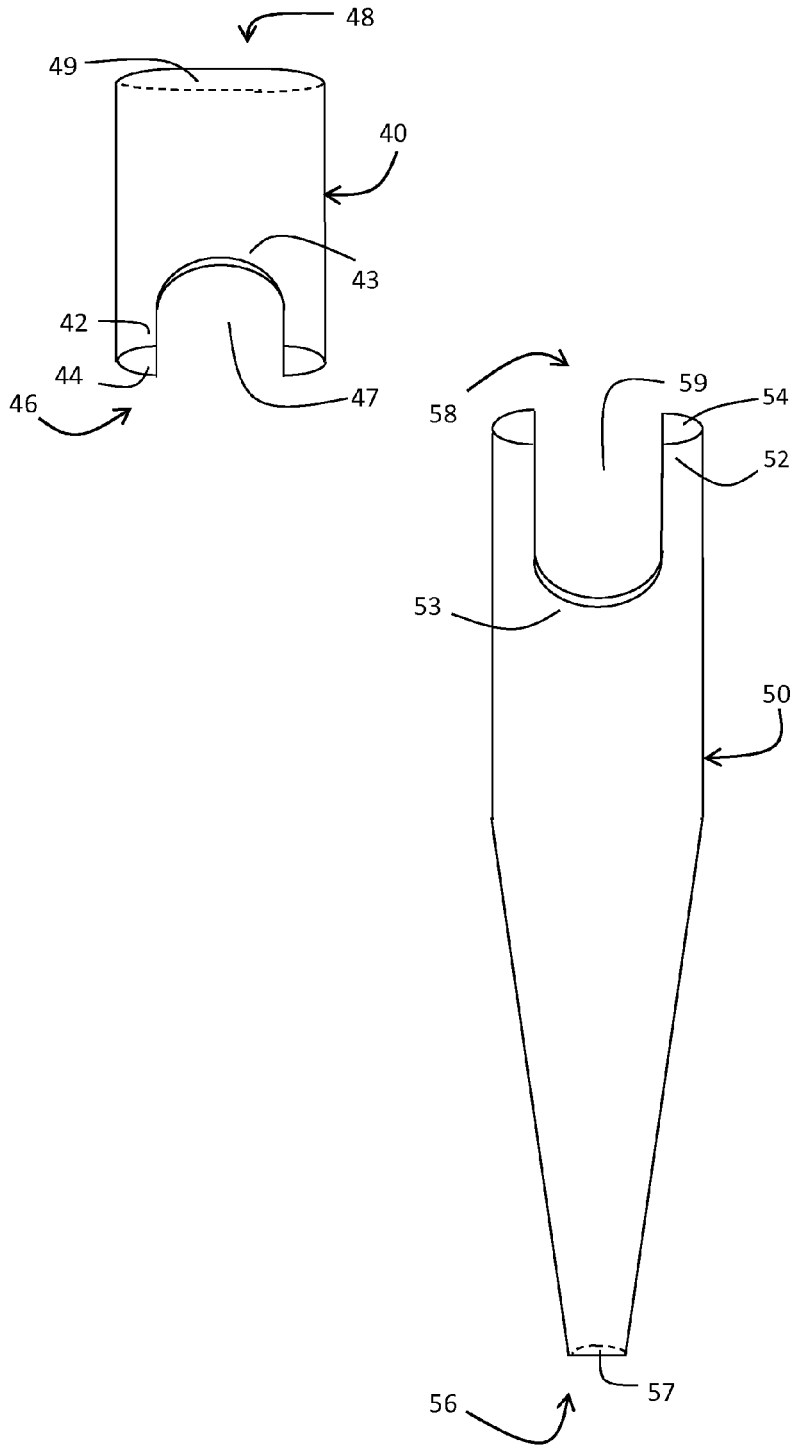
FIG. 2 is a front elevational view of one embodiment of two structure conferring members of the present invention.
Figure 3:
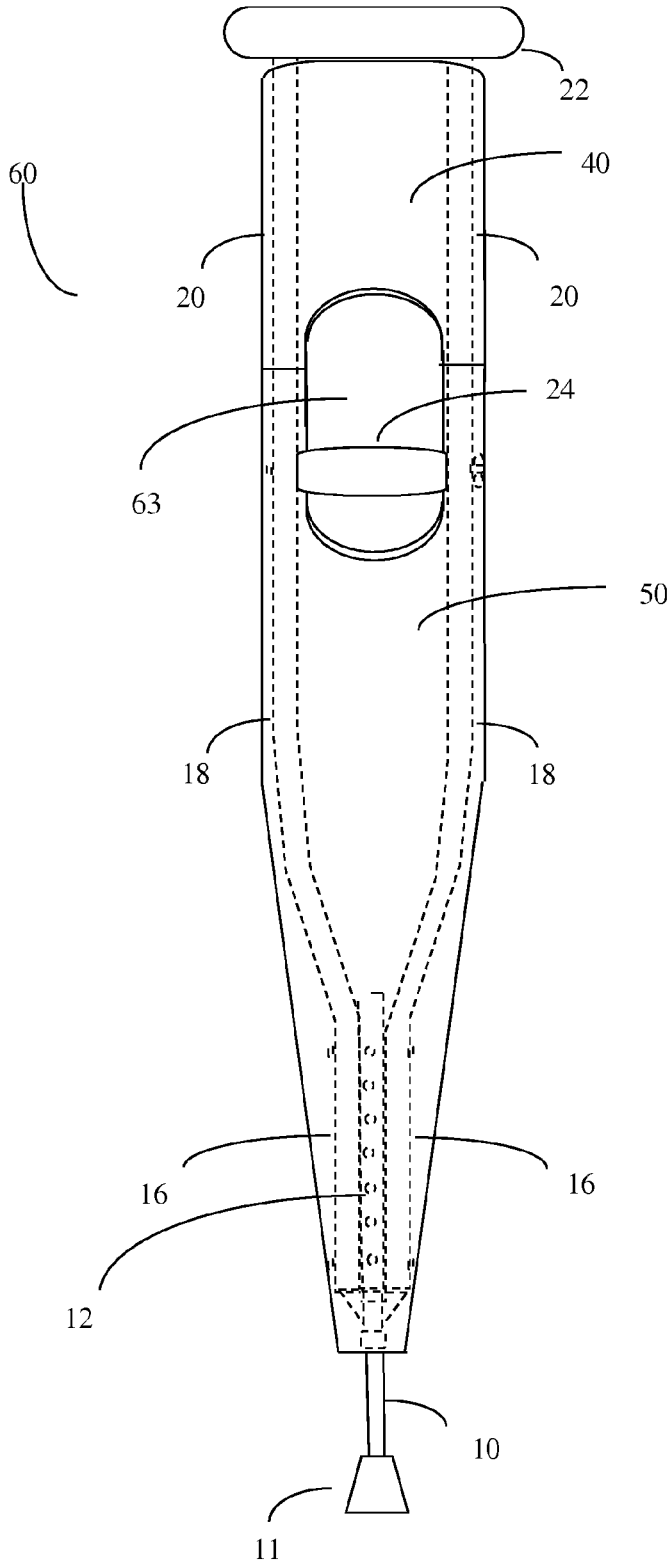
FIG. 3 is a front plan view of a combined structure conferring member as applied to the crutch of FIG. 1.
Figure 4:
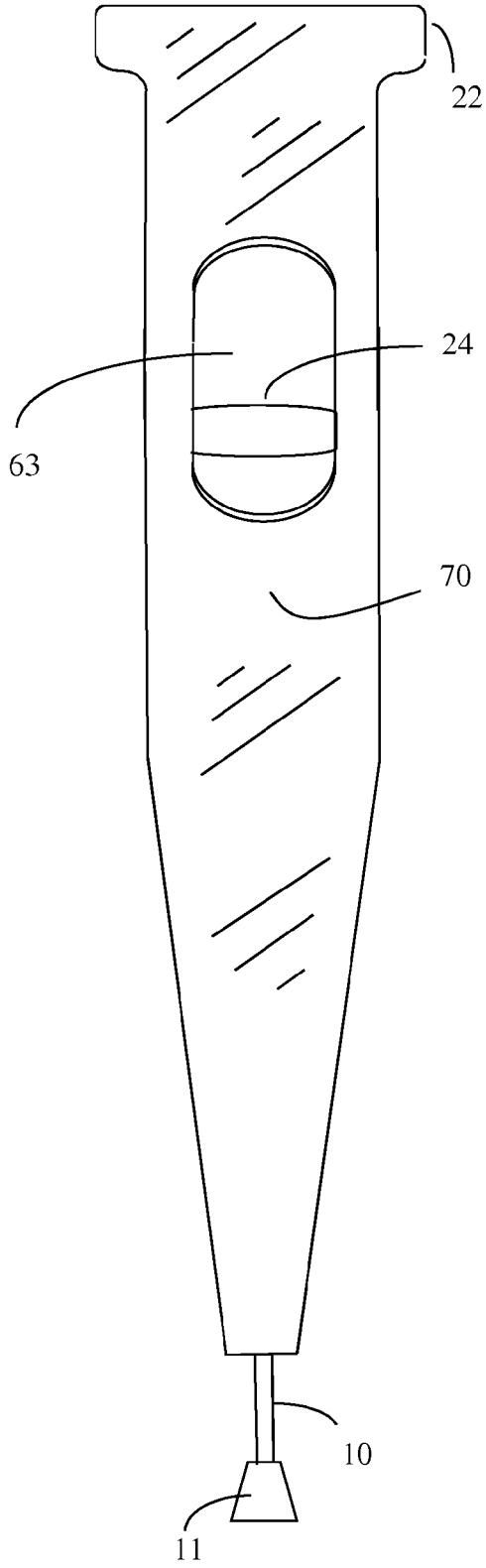
FIG. 4 is a front plan view of the combined structure conferring member and crutch shown in FIG. 3 having a printed flexible fabric sleeve applied thereto.

In one embodiment, the crutch decoration comprises two structure conferring members that are slidably engaged when applied to the crutch to form a combined structure conferring member. The combined structure conferring member encloses most portions of the crutch, including the areas between the two opposing upper crutch sections 20, between two opposing lower crutch sections 18, and between two opposing leg intersecting crutch sections 16. FIGS. 2 through 4 show one such embodiment. FIG. 2 shows a front elevational view of two structure conferring members: a top structure conferring member 40 and a bottom structure conferring member 50. These two structure conferring members, 40 and 50, slidably engage to form a combined structure conferring member 60 as shown in FIG. 3.

The top structure conferring member 40 shown in FIG. 2 has two opposed concave body sections 42 and 44, connected at their longitudinal ends and not connected at their proximal and distal ends thus creating a top structure conferring member 40 with openings at its proximal 46 and distal ends 48. The proximal 47 and distal 49 openings being large enough to snugly receive the width of the vertical columns of a crutch at their widest point. Each body section, 42 and 44, forms approximately half of the top structure conferring member 40. The body sections, 42 and 44, can be secured together, for instance, via sonic welding techniques, adhesives, mechanical fasteners, or other bonding or fastening technique. The body sections, 42 and 44, can also be releasably fastened by any appropriate fastening means. The body sections, 42 and 44, can also be secured together on one longitudinal end by a hinge structure and releasably fastened on the other longitudinal end by any appropriate fastening means.

The top structure conferring member 40 contains a half oval shaped cut-out 43 at the proximal end 46. The cut-out 43 can be a multitude of sizes, but must be large enough to allow for access to a crutch hand grip beam when the structure conferring member 40 is applied to a crutch. In some embodiments, the oval shaped cut-out 43 does not extend to body section 44. The cut-out 43 can be in the form of a half circle, rectangle, or other shape.

The bottom structure conferring member 50 shown in FIG. 2 has two opposed concave body sections 52 and 54, connected at their longitudinal ends and not connected at their proximal and distal ends thus creating a bottom structure conferring member 50 with openings at its proximal 58 and distal 56 ends. The proximal opening 59 is large enough to snugly receive the width of the vertical columns of a crutch at their widest point and a slidably engagable portion of the top structure conferring member 40. The distal opening 57 is large enough to receive a crutch leg and a lower end covered or capped crutch tip. Each body section, 52 and 54, forms approximately half of the bottom structure conferring member 50. The body sections, 52 and 54, can be secured together, for instance, via sonic welding techniques, adhesives, mechanical fasteners, or other bonding or fastening technique. The body sections, 52 and 54, can also be releasably fastened by any appropriate fastening means. The body sections, 52 and 54, can also be secured together on one longitudinal end by a hinge structure and releasably fastened on the other longitudinal end by any appropriate fastening means.

The bottom structure conferring member 50 contains a half oval shaped cut-out 53 at the proximal end 58. The cut-out 53 can be a multitude of sizes, but must be large enough to allow for access to a crutch hand grip beam when the structure conferring member 50 is applied to a crutch. In some embodiments, the oval shaped cut-out 53 does not extend to body section 54. The cut-out 53 can be in the form of a half circle, rectangle, or other shape.

As shown in FIG. 3, a top structure conferring member 40 and a bottom structure conferring member 50 are applied to a crutch and slidably engaged to form a combined structure conferring member 60. The top structure conferring member 40 is first applied to the crutch with the distal opening 48 receiving the lower end capped crutch tip 11 and moving upward along the crutch until it rests just below the arm-pit engaging beam 22. The bottom structure conferring member 50 is then applied to the crutch with the proximal opening 59 receiving the lower end capped crutch tip 11 and moving upward along the crutch until it is slidably engaged with the top structure conferring member 40. More specifically, the proximal end of the top structure conferring member 46 fits snugly inside the proximal end of the bottom structure conferring member 58. In other embodiments, the proximal end of the bottom structure conferring member 58 fits snugly inside the proximal end of the top structure conferring member 46. Ridges or stops may be provided on the interior of the proximal end of the top structure conferring member 46 and/or the interior of the proximal end of the bottom structure conferring member 58 to allow for appropriate positioning of the top and bottom structure conferring members in relation to each other.

Once the top structure conferring member 40 and the bottom structure conferring member 50 are engaged, cut-outs 43 and 53 together form a full oval shaped cut-out 63 at an area near the hand grip beam. The full oval shaped cut-out 63 is an example of a hand grip beam opening. The amount of overlap between the top 40 and bottom 50 structure conferring members once slidably engaged corresponds inversely with the size of the hand grip beam opening and the crutch length. Accordingly, a combined structure conferring member 60 will have a smaller overlap between the top 40 and bottom 50 structure conferring members and a larger hand grip beam opening when applied to a longer crutch as compared to when the same combined structure conferring member 60 is applied to a shorter crutch.

In one specific embodiment of the present invention, the front plan longitudinal length of the top structure conferring member 40 is approximately 20.00 inches, the front plan width of the top structure conferring member 40 is approximately 5.50 inches, and the side plan width of the top structure conferring member 40 ranges from approximately 0.85 inches at its narrowest part to approximately 1.00 inch at its widest part. In a further specific embodiment, the height of the half oval shaped cut-out 43 is approximately 8.50 inches, and the width of the half oval shaped cut-out 43 is approximately 4.75 inches at its widest part.

In another specific embodiment of the present invention, the front plan longitudinal length of the bottom structure conferring member 50 is approximately 39.00 inches, the front plan width of the bottom structure conferring member 50 is approximately 5.50 inches at its widest part, and the side plan width of the top structure conferring member 50 ranges from approximately 1.00 inch at its narrowest part to approximately 1.50 inches at its widest part. In a further specific embodiment, the height of the half oval shaped cut-out 53 is approximately 10.00 inches, the width of the half oval shaped cut-out 53 is approximately 4.75 inches at its widest part, and the tip opening 59 has a front plan width of approximately 1.50 inches and a side plan width of approximately 1.00 inch.

The combined structure conferring member 60 encloses two opposing upper crutch sections 20, two opposing lower crutch sections 18, two opposing leg intersecting crutch sections 16, and a portion of the crutch leg 10. Accordingly, the combined structure conferring member 60 is an example of an enclosable sleeve. The term "enclosable sleeve" refers herein to an object or material that is open at one or both ends that slides or pulls upwardly to enclose a portion of a crutch or decoration member. The combined structure conferring member 60 does not enclose the arm-pit engaging beam 22, the hand grip beam 24 or the capped tip 11. Accordingly, the combined structure conferring member 60 forms a substantially flat surface area across an area between two opposing upper crutch sections 20, between two opposing lower crutch sections 18 and between two opposing leg intersecting sections 16. In fact, a substantially flat surface is created on each side of the crutch when the combined structure conferring member 60 is applied thereto. These substantially flat surfaces are only interrupted by hand grip beam openings.

The structure conferring members of the present invention can be made from any material including, but not limited to, a moldable plastic, foam, rubber, cardboard, wood composite, metal, carbon fiber, and any combination thereof. In a preferred embodiment, the structure conferring member is made from a moldable plastic. The moldable plastic can be either a thermoset type, a thermosoftening type (also referred to as a thermoplastic), or an elastomer type. Moldable plastic articles are commonly manufactured from plastic powders in which desired shapes are fashioned by compression, transfer, injection, vacuum, or extrusion molding. In compression molding, materials are generally placed immediately in mold cavities, where the application of heat and pressure makes them first plastic, then hard. The transfer method, in which the compound is plasticized by outside heating and then poured into a mold to harden, is used for designs with intricate shapes and great variations in wall thickness. Injection-molding machinery dissolves the plastic powder in a heating chamber and by plunger action forces it into cold molds, where the product sets. The operations take place at rigidly controlled temperatures and intervals. Extrusion molding employs a heating cylinder, pressure, and an extrusion die through which the molten plastic is sent and from which it exits in continuous form to be cut in lengths or coiled. The moldable plastic can be made of a polypropylene, polystyrene, polyester, polyurethane, polyethylene, or any combination thereof. In a preferred embodiment, the moldable plastic is a styrene ABS plastic. In other embodiments, the structure conferring member is a foam. Foams that can be used in the present invention include, but are not limited to, polyethylene mini cell foam (L200), ethylene foam, and bead foam. In some embodiments, the hardened moldable plastic or foam is printed or dyed directly with a color, design or advertisement.

Dyed or printed advertisements that can be placed on the structure conferring members include, for example, professional sports team logos, pictures and slogans; collegiate sports team logos, pictures and slogans; high school sports team logos, pictures and slogans; and recreational sports team logos, pictures and slogans. Advertisements for children's products, toys and movies can also be placed on the structure conferring members of the present invention. The structure conferring members of the present invention can further include advertisements of fashion designs or personalized pictures. As used herein, the term "advertisement" refers to any grouping of letters, numbers, pictures, drawings, symbols, or other writing created for any purpose.

In other embodiments of the present invention, the structure conferring member is not printed directly, but is instead covered with a dyed or printed flexible fabric that is removable. One important advantage provided by these embodiments of the invention is that the dyed or printed flexible fabric can be easily changed, thereby allowing the design or advertisement on the crutch or walker to be changed quickly and/or often. Flexible fabrics used with the invention can be made from one or more of a multitude of different materials including, but not limited to, Lycra™ Spandex™, polyester, nylon, cotton, and neoprene. In a preferred embodiment, the structure conferring member is covered with a flexible stretch-fit fabric that is a blend of polyester and Spandex™. Stretch-fit flexible fabric sleeves can be easily pulled on or off the structure conferring member from the member's distal or proximal end. As defined herein, a "stretch-fit" material conforms to the shape of the underlying structure conferring member and fits snugly thereupon. Other flexible fabrics may be easily removable by including or attaching to them a releasable means of fastening such as snaps, Velcro, ties, pins, or adhesives.

The terms "cover" and "covered" as used herein do not require 100% wrapping of the object and include a partially wrapped object. Accordingly, the structure conferring member can be covered with a flexible fabric sleeve that is open at one or both ends or is open at an area near the crutch hand grip beam when the sleeve is applied to the crutch. For example, as shown in FIG. 4, a structure conferring member or a combined structure conferring member of the present invention can be covered with a flexible fabric sleeve 70 that is open at an area adjacent the arm-pit engaging beam 22, open at an area adjacent the crutch hand grip beam 24, and open at an area adjacent the crutch capped tip 11 once the structure conferring member or combined structure conferring member is applied to the crutch. A structure conferring member or a combined structure conferring member can also be covered with a flexible fabric sleeve that is closed at an area adjacent the arm-pit engaging beam (and covers the arm-pit engaging beam), open at an area adjacent the crutch hand grip beam, and open at an area adjacent the crutch foot once the structure conferring member or combined structure conferring member is applied to the crutch.

The flexible fabrics are printed in a manner that allows for minimal misconfiguration of the printed image once the fabric is applied to the crutch and the crutch length/height is adjusted. Dyed or printed advertisements that can be placed on the flexible fabrics of the present invention can include, for example, professional sports team logos, pictures and slogans; collegiate sports team logos, pictures and slogans; high school sports team logos, pictures and slogans; and recreational sports team logos, pictures and slogans. Advertisements for children's products, toys and movies can also be placed on the flexible fabrics of the present invention. The flexible fabrics of the present invention can further include advertisements of fashion designs or personalized pictures.

Methods that may be used to print a structure conferring member and/or a flexible fabric of the present invention include, but are not limited to, direct printing, discharge printing, and resist printing, block printing, roller printing, duplex printing, stencil printing, screen printing, transfer printing, blotch printing, jet spray printing, electrostatic printing, photo printing, differential printing, warp printing, sublimation printing, batik dyeing, tie dying, airbrush painting and digital printing.

It should also be understood that the foregoing relates to preferred embodiments of the present invention and that numerous changes may be made therein without departing from the scope of the invention.

I claim:

1. A crutch decoration for use with a crutch which includes a load-supporting frame with two or more vertical crutch columns, two or more crutch beams, and one or more crutch feet comprising two structure conferring members, wherein each structure conferring member forms a substantially flat surface across an area between two of the vertical crutch columns when applied to the crutch, wherein an upper structure conferring member forms a substantially flat surface across an area between two opposing upper crutch portions of the vertical crutch columns and a lower structure conferring member forms a substantially flat surface across an area between two opposing lower crutch portions of the vertical crutch columns; wherein:

the upper and lower structure conferring members are slidably engaged to form a combined structure conferring member, and wherein:

a. the combined structure conferring member surrounds two opposing upper crutch portions of the vertical crutch columns, two opposing lower crutch portions of the vertical crutch columns, two opposing leg intersecting portions of the vertical crutch columns, and a crutch leg portion, b. the upper and lower structure conferring members provide a crutch hand grip beam access area at the lower and upper ends, respectively, of the structure conferring members, c. the two structure conferring members are slidably engaged at their respective hand grip beam access areas proximal to a crutch hand grip beam, and d. a crutch arm-pit engaging beam and the crutch hand grip beam are accessible.

2. The crutch decoration of claim 1, wherein the two structure conferring members comprise a hardened moldable plastic.

3. The crutch decoration of claim 2, wherein the moldable plastic is a styrene ABS plastic.

4. The crutch decoration of claim 2, wherein the combined structure conferring member comprises an oval opening near the crutch hand grip beam.

5. The crutch decoration of claim 2, wherein the combined structure conferring member is covered with a flexible fabric.

6. The crutch decoration of claim 5, wherein the flexible fabric is a stretch-fit fabric.

7. The crutch decoration of claim 5, wherein the flexible fabric has an advertisement printed or dyed thereupon.

8. The crutch decoration of claim 5, wherein the flexible fabric has a color or design printed or dyed thereupon.

* * * * *